US009478859B1

(12) United States Patent
Nair et al.

(10) Patent No.: US 9,478,859 B1
(45) Date of Patent: Oct. 25, 2016

(54) MULTI-BAND COMPACT PRINTED CIRCUIT ANTENNA FOR WLAN USE

(71) Applicants: Deepu Vasudevan Nair, Thiruvananthapuram (IN); Varun Ramchandani, Kota (IN); Partha Sarathy Murali, San Jose, CA (US); Suresh Kumar Vagvala, Hyderabad (IN)

(72) Inventors: Deepu Vasudevan Nair, Thiruvananthapuram (IN); Varun Ramchandani, Kota (IN); Partha Sarathy Murali, San Jose, CA (US); Suresh Kumar Vagvala, Hyderabad (IN)

(73) Assignee: Redpine Signals, Inc., San Jose, CA (US)

( * ) Notice: Subject to any disclaimer, the term of this patent is extended or adjusted under 35 U.S.C. 154(b) by 169 days.

(21) Appl. No.: 14/176,127

(22) Filed: Feb. 9, 2014

(51) Int. Cl.
*H01Q 1/24* (2006.01)
*H01Q 5/00* (2015.01)
*H01Q 1/48* (2006.01)

(52) U.S. Cl.
CPC ..... *H01Q 5/0027* (2013.01); *H01Q 1/48* (2013.01); *H01Q 5/0093* (2013.01)

(58) Field of Classification Search
CPC ..... H01Q 13/206; H01Q 9/0407
USPC ..... 343/700 MS, 848, 722, 745, 749, 793
See application file for complete search history.

(56) References Cited

U.S. PATENT DOCUMENTS 7,403,160 B2 7/2008 Chiang et al.
7,586,452 B2 9/2009 Li et al.
7,742,006 B2 6/2010 Villarroel et al.
8,284,115 B2 10/2012 Nysen et al.
8,344,959 B2 1/2013 Autti et al.
8,587,491 B2 11/2013 Badaruzzaman et al.
2003/0016177 A1* 1/2003 Deguchi ..... H01Q 1/242 343/702
2003/0098812 A1* 5/2003 Ying ..... H01Q 1/243 343/702
2009/0128425 A1* 5/2009 Kim ..... H01Q 1/243 343/702

FOREIGN PATENT DOCUMENTS

EP 1351334 A1 * 10/2003 ..... H01Q 9/0421

OTHER PUBLICATIONS

Sun, Liu, Cheung, Yuk, "Dual-Band Antenna With Compact Radiator for 2.4/5.2/5.8 GHz WLAN Applications".

* cited by examiner

*Primary Examiner* — Sue A Purvis
*Assistant Examiner* — Jae Kim
(74) *Attorney, Agent, or Firm* — File-EE-Patents.com; Jay A. Chesavage

(57) ABSTRACT

A printed circuit tri-band antenna has a feedline region and a radiating structure region which provides RF emissions in a lowband (LB) RF frequency, a lower highband (HB-L) frequency, and a upper highband (HB-U) frequency. The feedline region is formed of conductors on an upper plane, the conductors including a feedline which is edge coupled to left and right ground structures. The feedline couples directly to a HB-U radiating structure, and includes a stub. The HB-U structure and stub also provide edge coupling through a gap for coupling RF into a combined HB-L and LB radiation structure, which provides frequency-dependent paths for radiating RF energy at the HB-L and LB frequencies. The antenna is preferably used with 2.35 Ghz LB, 5.07 GHz HB-L, and 5.57 Ghz HB-H.

18 Claims, 5 Drawing Sheets

*Figure 1*
Printed Circuit Antenna
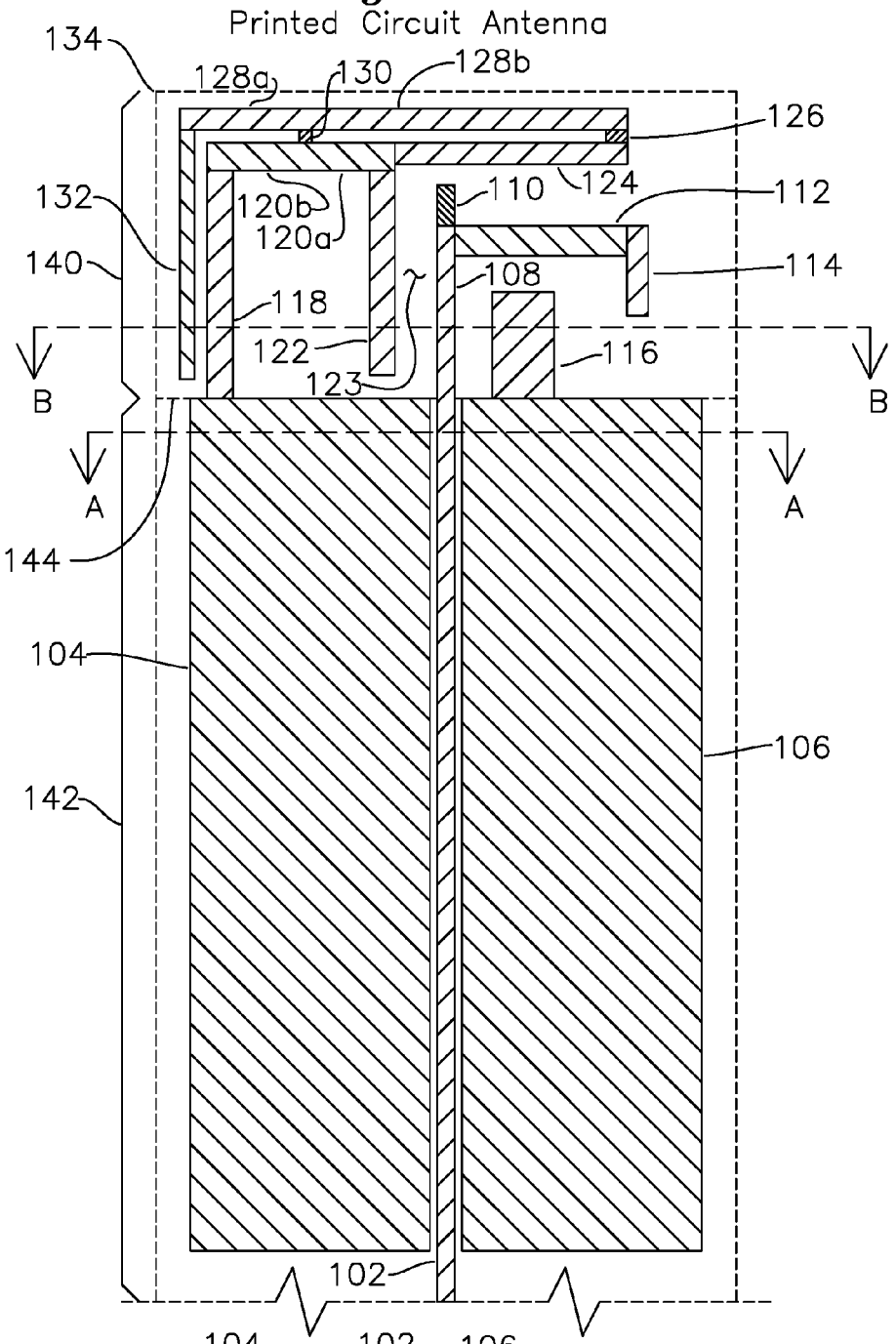
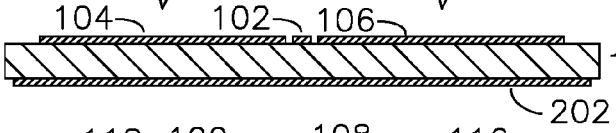
*Figure 2A*
Section A–A
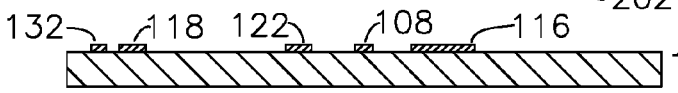
*Figure 2B*
Section B–B tri-band circuit structures

*Figure 5*
Printed Circuit Antenna
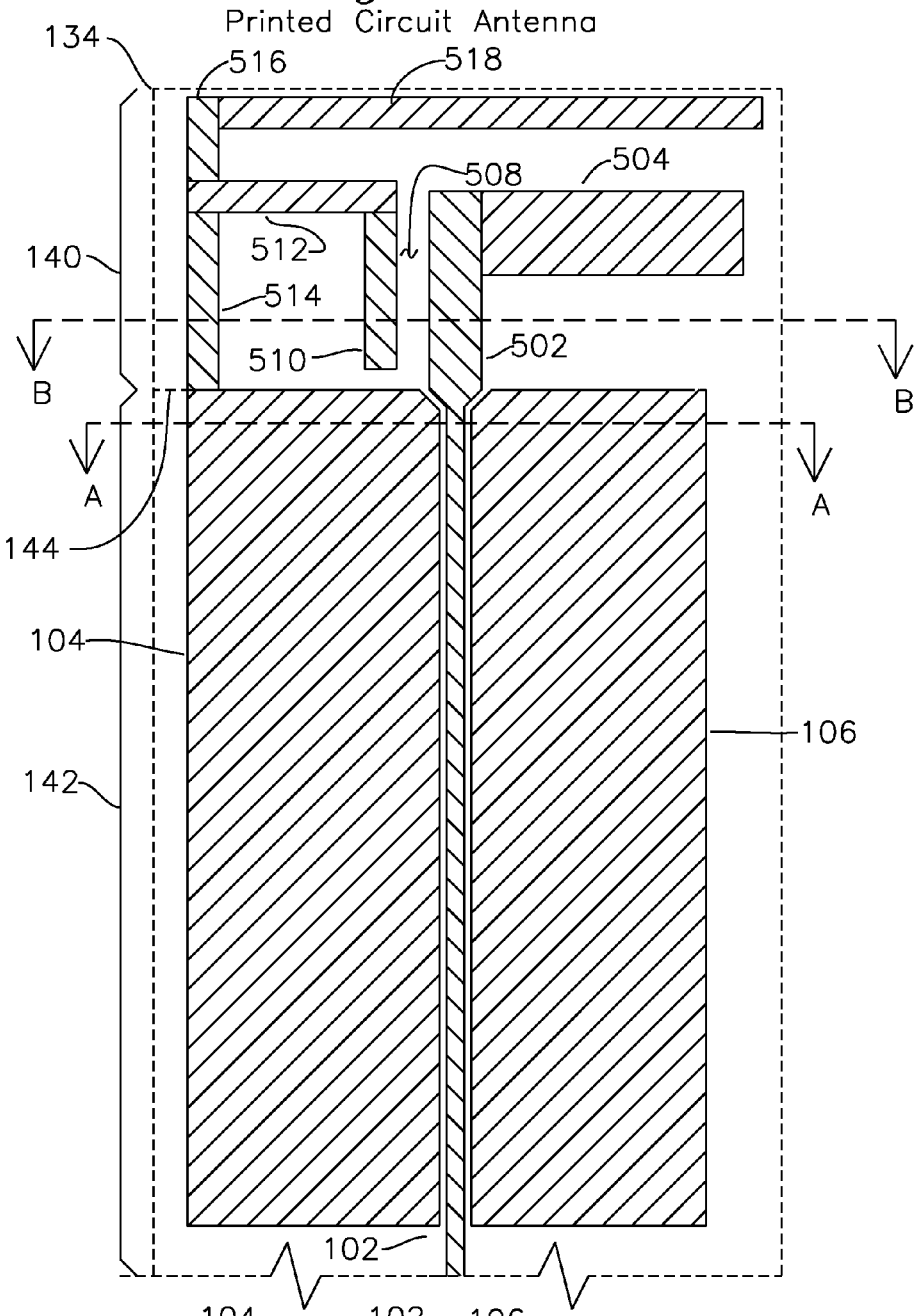
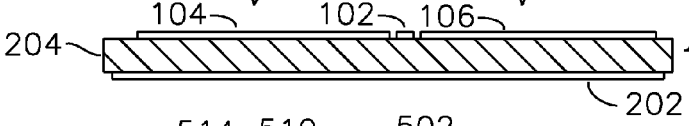
*Figure 5A*
Section A–A
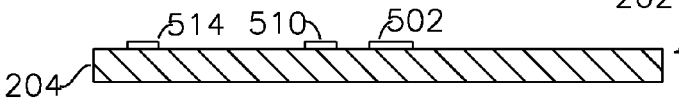
*Figure 5B*
Section B–B Printed Circuit Antenna

MULTI-BAND COMPACT PRINTED CIRCUIT ANTENNA FOR WLAN USE

FIELD OF THE INVENTION

The present invention relates to an antenna structure. In particular, the invention provides an antenna structure suitable for use on a printed circuit board for Wireless Local Area Network (WLAN) use, where the antenna radiates over multiple frequency bands corresponding to several WLAN frequency bands.

BACKGROUND OF THE INVENTION

Wireless Local Area Network (WLAN) stations and access points operate in at least one of the several WLAN frequency bands centered about 2.4 GHz, 4.9 GHz, 5.2 GHz, 5.5 GHz, and 5.8 GHz. Typically, each frequency requires a separate quarter wavelength antenna structure. In free space, a quarter wavelength for each of 2.4 GHz (Low Band, referred to herein as LB), 5.07 GHz (High Band Lower, referred to herein as HB-L), and 5.57 GHz (High Band Upper, referred to herein as HB-U) is approximately 31 mm, 14.7 mm and 13.4 mm, respectively. A printed circuit substrate such as FR4 has a permittivity $\in$ of 4.2 on one surface and free air on the other, so the lengths of the quarter wavelength shortens by a scaling factor of approximately $$\sqrt{\frac{\varepsilon+1}{2}},$$

or 62% of the free space wavelength. In the prior art, each antenna structure is implemented with a separate quarter wave radiating structure implemented on a conductive pattern printed on FR4 substrate. It is desired to provide a single radiating antenna structure for use with a plurality of RF frequencies for use in a LAN.

OBJECTS OF THE INVENTION

A first object of the invention is a printed circuit antenna fed by a wideband feedline delivering to the radiating antenna multiple separate operating frequencies which the radiating antenna radiates efficiently at each separate operating frequency and presents a minimum return loss at each particular operating frequency to the feedline, the radiating frequencies including at least a Low Band (LB) frequency, High Band Lower (HB-L) frequency, and a High Band Upper (HB-U) frequency.

A second object of the invention is a printed circuit antenna formed from a two-sided circuit board having a feedline part and a radiating antenna part, the feedline part formed from conductors on an upper plane separated from an optional lower ground plane by a dielectric, the ground plane present in the feedline part and not present in the antenna part, the feedline region optionally having one or more edge-coupled ground reference structures, the radiating structure including:

a High Band Upper (HB-U) radiating part for frequencies such as 5.57 Ghz, the HB-U radiating part comprising, in sequence, a first segment coupled to the feedline, a second segment, and a third segment;

a lowband (LB) radiating part for frequencies such as 2.46 Ghz, the LB radiating part comprising in sequence, a fourth segment coupled to a fifth segment LB radiator, a fifth segment common radiator, and a sixth segment terminated to a ground reference, the fourth segment coupled through a gap to the first segment and to a first stub extended from the first segment;

a highband lower (HB-L) radiating structure for frequencies such as 5.07 GHz, the radiating part comprising, in sequence, the fourth segment for coupling HB-L RF from the first segment and first stub, the fourth segment coupled to a fifth segment LB radiator, the HB-L radiating structure comprising the sixth segment, the fifth segment common radiator, a bridge, a seventh segment HB-L radiator, and an eighth segment;

an inductive stub placed between the junction of the fifth segment LB radiator and fourth segment, and the intersection of the bridge and the seventh segment HB-L radiator, the inductive stub comprising, in series, a tenth segment, a ninth segment, and a seventh segment.

SUMMARY OF THE INVENTION

A feedline region 142 comprises a feedline 102 in a first plane which is separated from a ground plane 202 by a dielectric 204. The feedline 102 is optionally edge coupled to a left ground structure 104 or a right ground structure 106, the left ground structure 104 and right ground structure 106 formed by a conductor in the first plane which is either connected directly to the ground plane 202 or is formed by a conductive region which is at the same electrical potential as the ground plane 202, such as by a close proximity of the ground structures 104, 106 and the ground plane 202. The feedline 102, left ground structure 104, and right ground structure 106 are electrical conductors all located on the first plane of a circuit board, below which is a reference ground plane 202 which serves as a reference plane for the feedline 102 and separated by a dielectric material 204 such as FR4. The feedline and associated structures thereby provide a particular feedline 102 impedance, such as 50 ohms. Beyond the extent of the feedline 102, left ground structure 104, and right ground structure 106 is a radiating antenna region 140 which contains radiating structures formed as electrically conductive segments without a ground plane 202 below.

In one embodiment of the invention, the feedline 102 transitions over the edge 144 of a ground plane 202 to the antenna region 140 which includes a first segment 108, second segment 112, and third segment 114, which form a highband-upper HB-U RF radiator for RF delivered by the feedline in this frequency range. The first segment 108 and a first stub 110 which extends from the first segment 108 are coupled through a gap region 123, and in sequence to, a lowband (LB) radiator formed by a fourth segment 122, fifth segment LB radiator **120*a*, fifth segment common radiator 120*b*, and sixth segment 118, which is terminated in a ground reference such as left ground structure 104. The LB radiator structure thereby radiates LB RF coupled from the feedline 102 and first stub 110**.

A highband lower (HB-L) radiator is formed from the sixth segment 118, fifth segment common radiator **120*b*, a bridge 130, a seventh segment HB-L radiator 128*a*, and an eighth segment 132, where the HB-L radiator receives RF energy in the HB-L frequency range from the feedline 102, which couples across gap 123, through the fourth segment 122 and fifth segment LB radiator 120*a*, which are capacitively coupled for the HB-L frequency. An LB inductive structure (which is inductive for LB frequencies) is coupled from the intersection of the bridge 130 and the seventh segment HB-L radiator 128*a* to the intersection of the fifth segment LB radiator 120*a* and fourth segment 122, and the LB inductive structure comprises, in sequence, a seventh segment inductive 128***b*, a ninth segment 126, and a tenth segment 124.

When the feedline 102 is fed with a lowband (LB) frequency such as 2.46 GHz, the RF travels from the feedline 102 through first segment 108 and first stub 110, coupling through a separation gap 123 to the fourth segment 122, fifth segment LB radiator 120*a*, fifth segment common radiator 120*b*, and sixth segment 118, the terminus of which is ground referenced such as with left ground structure 104. At 2.4 GHz, an inductive stub is formed by the segments 124, 126, 128*b*, 128*a*, and 132. When the feedline 102 is fed with a highband lower (HB-L) frequency such as 5.07 GHz, the RF travels from the feedline 102 to the first segment 108 and stub 110, edge couples through gap 123 to fourth segment 122 and fifth segment LB radiator 120*a* to the HB-L radiating structure formed by the sequence of sixth segment 118, fifth segment common radiator 120*b*, bridge 130, seventh segment HB-L radiator 128*a* and eighth segment 132.

When the feedline 102 is fed with a highband upper (HB-U) frequency such as 5.57 GHz, the RF travels from the feedline 102 to the first segment 108, second segment 112, and third segment 114.

BRIEF DESCRIPTION OF THE DRAWINGS

FIG. 1 is top view of a printed circuit antenna.

FIG. 2A is a cross section view of FIG. 1 at section A-A.

FIG. 2B is a cross section view of FIG. 1 at section B-B.

FIG. 5 is another embodiment of a tri-band antenna.

FIG. 5A is a cross section view of FIG. 5 at section A-A.

FIG. 5B is a cross section view of FIG. 5 at section B-B.

DETAILED DESCRIPTION OF THE INVENTION

Figure 3:
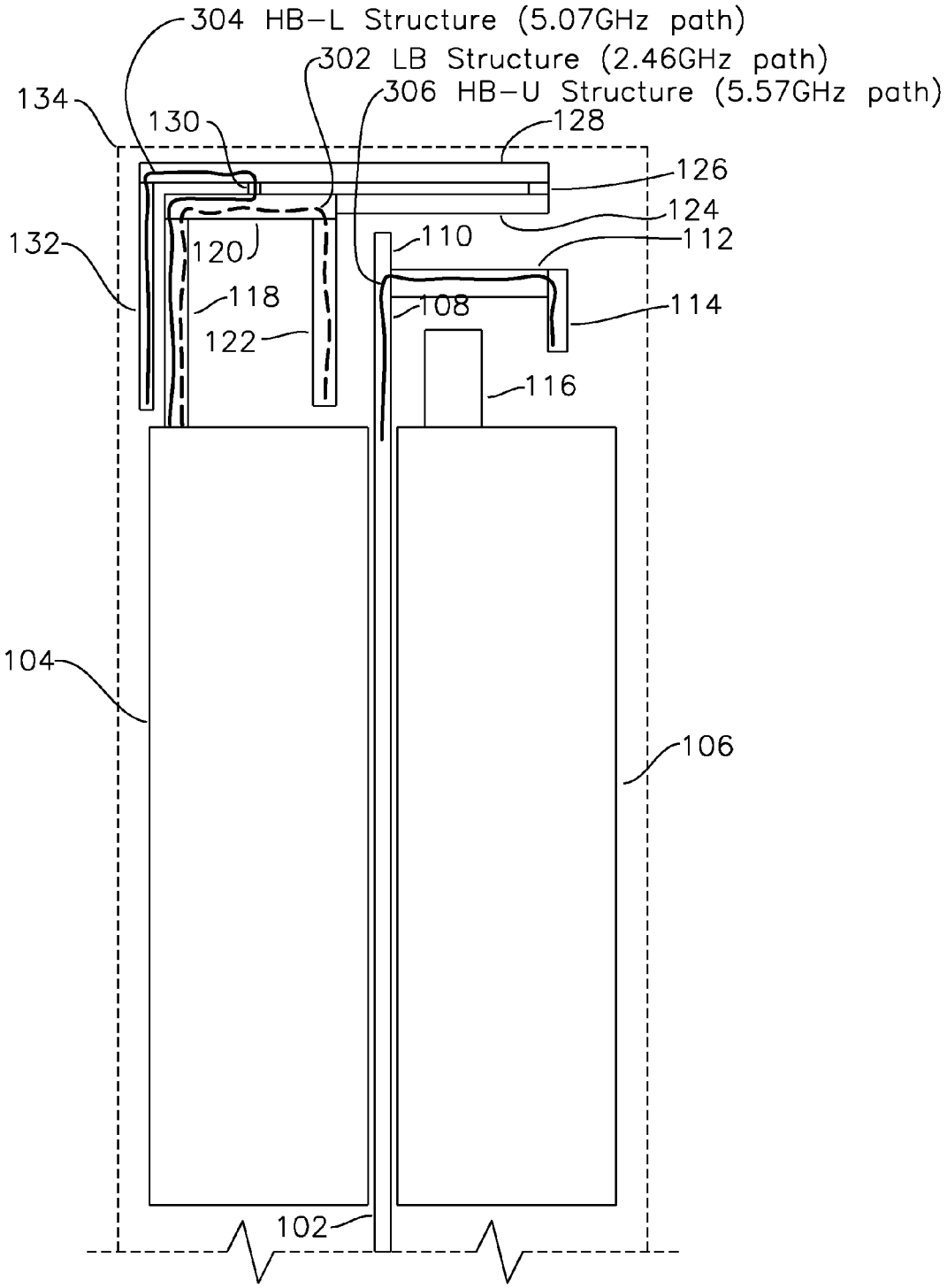
FIG. 3 is a diagram showing tri-band radiating paths for the antenna of FIG. 1.

FIG. 1 shows a printed circuit antenna according to the present invention. The antenna comprises a feedline region 142 and a radiating region 140, which may be viewed in combination with FIGS. 2A and 2B showing the cross section view A-A and section B-B of FIG. 1, respectively. There are several techniques known in the prior for forming a feedline, which has the characteristics of substantially constant impedance and return loss over a wide range of frequencies, when properly terminated. One type of feedline is known as a Co-Planar Waveguide (CPW), where feedline 102 is edge coupled to co-planar ground references such as co-planar conductors 104 and 106 at ground potential, but without ground plane 202 on a plane below the feedline 102 plane. Another type of feedline is known as a co-planar waveguide with ground plane, shown with the addition of ground plane 202 of FIG. 2A. Any type of feedline may be used to convey power to the radiating region 140, although in the present example, a grounded CPW is shown. When using co-planar feedlines, the grounded structures 104 and 106 may be used to provide ground potential to other structures, such as the terminus of sixth segment 118.

In the embodiment shown in FIGS. 1, 2A, and 2B, the feedline region 142 is formed of top layer conductors (102, 104, 106 in section A-A) such as formed by etching a copper layer on an upper plane and with a continuous ground plane conductor 202 on a lower plane separated by a dielectric layer 204. The ground layer may be present on a bottom layer, or any intervening layer, in the case of a multi-layer PCB. The radiating region 140 does not have a ground plane below, as shown in section view A-A of FIG. 1 shown in FIG. 2A, and the structures in region 140 are either radiating RF structures or capacitive or inductive structures which provide coupling paths for RF which are quarter wavelength or half wavelength for the frequency of interest. Feedline 102 has a first edge which is coupled to left ground structure 104, and a second edge opposite the first edge, which is coupled to right ground structure 106.

In one embodiment of the invention shown in FIG. 1, the antenna contains structures for preferential radiation at 2.46 Ghz RF (lowband LB radiation) which may be considered to include at least the frequency range from 2.38 to 2.52 GHz, 5.07 GHz RF (HB-L radiation), and 5.57 Ghz RF (HB-U radiation), where the HB-L frequency band and HB-U frequency band together span the frequency range from 4.89 GHz to 5.91 GHz, where the operating frequency band may also be defined as a frequency range where the voltage standing wave ratio (VSWR) is less than 2:1. Alternatively, the frequency range for each of HB-U, HB-L, and LB may be specified in return loss measured at the feedline.

FIG. 1 shows feedline 102 having several ground references, one of which is ground plane 202 through dielectric 204 (shown in FIG. 2A and FIG. 2B for sections A-A and B-B, respectively). Left ground structure 104 and right ground structure 106 both have a large surface area which is capacitively coupled to ground plane 202 through dielectric 204. Left ground structure 104 and right ground structure 106 are edge coupled to feedline 102. As previously indicated, ground plane 202 is present over extent 142, and is not present in radiating region 140. Accordingly, feedline 102 crosses the edge of ground plane 202 at boundary 144 and thereafter feedline 102 becomes first segment 108, which in combination with second segment 112 and third segment 114 forms a radiating structure for high band-upper (HB-U) frequencies. In addition to radiating HB-U frequencies, first segment 108 also couples low band (LB) RF and high band lower (HB-L) frequencies across gap 123 to fourth segment 122, which forms a LB radiating structure with fifth segment LB radiator 120*a*, fifth segment common radiator 120*b*, and sixth segment 118, which terminates into co-planar left ground structure 104. In an alternative embodiment, the sixth segment 118 may terminate through a via to the ground plane layer at the ground plane 202 edge 144, however it is preferred to utilize a co-planar ground to avoid any parasitic inductance of a via to a non-coplanar ground layer.

At the junction of fifth segment LB radiator 120*a* and fifth segment common radiator 120*b* is bridge 130, which couples HB-L RF to HB-L radiators formed by the sequence of eighth segment 132, seventh segment HB-L radiator 128*a*, bridge 130, fifth segment common radiator 120*b*, and sixth segment 118.

Bridge 130 is also connected to seventh segment inductive 128*b*, ninth segment 126, and tenth segment 124 connected to the junction of fifth segment LB radiator 120*a* and fourth segment 122. Seventh segment inductive 128*b*, ninth segment 126, and tenth segment 124 operate together to form an inductive stub for LB coupled to fourth segment 122, directing energy to the LB radiating structure formed by 122, 120*a*, 120*b*, and 118. Bridge 130 also forms the HB-L resonant structure which couples HB-L RF energy from first segment 108 across gap 123 to fourth segment 122, and to the HB-L resonant structure formed by fifth segment common radiator 120*b*, sixth segment 118, bridge 130, seventh segment HB-L radiator 128*a*, and eighth segment 132.

In one embodiment, the tri-band radiator is formed from segment structures which perform functions as described below:

102—feedline with broadband frequency characteristics, referenced to ground plane 202 and adjacent left and right ground structures 104 and 106, respectively. Feedline 102 carries LB, HB-U and HB-L RF.

104 and 106—left and right ground structures, respectively. These provide edge coupling to feedline 102 and also provide ground references to other structures, including the end of sixth segment 118 and ground reference segment 116.

108—first segment, part of HB-U radiating structure with second segment 112 and third segment 114. First segment 108 also couples LB and HB-L RF to fourth segment 122 through gap 123.

112—second segment, part of HB-U radiating structure.

114—third segment, part of HB-U radiating structure.

110—first stub coupling LB and HB-L to fourth segment 122.

122—fourth segment, part of LB radiating structure, which also couples HB-L RF from first segment 108 and first stub 110 across gap 123 to associated radiating structures 118, 120*b*, 130, 128*a*, and 132.

120*a*—fifth segment LB radiator, part of LB radiating structure 122, 120*a*, 120*b*, and 118.

120*b*—fifth segment common radiator, part of both LB and HB-L radiating structures.

118—sixth segment, part of HB-L radiating structure, grounded at terminus by left ground 104.

128*b*, 126, 124—seventh segment inductive, ninth segment, and tenth segments, respectively, form an inductive stub for LB, allowing coupling of RF into the LB radiator formed by 122, 120, and 118.

The structures of FIG. 1 may be sized to operate as radiating RF structures over the multi-band frequency ranges 2.4 Ghz, 4.9 Ghz, 5.2 Ghz, 5.5 Ghz, and 5.8 Ghz using an FR4 substrate with a dielectric constant of 4.2 and a dielectric thickness of 0.25 mm.

For highband upper (HB-U) RF such as 5.57 GHz, feedline 102 couples RF to the HB-U radiating elements comprising first segment 108, second segment 112, and third segment 114. Reference segment 116 provides edge coupling to the HB-U radiating elements and increases the effective bandwidth of the HB-U radiating elements. The HB-U elements 108, 112, and 114 act as a quarter wave radiator at 5.57 Ghz.

For a lowband (LB) radiation frequency such as 2.46 GHz, the physical dimensions of the conductor segments are selected to provide coupling of LB RF from first segment 108 and first stub 110 to the LB RF radiating structure comprising fourth segment 122, fifth segment LB radiator 120*a*, fifth segment common radiator 120*b*, and sixth segment 118. For the LB frequency, the seventh segment inductive 128*b*, ninth segment 126, and tenth segment 124 act as an inductive stub, shortening the length of LB radiation structure 122, 120*a*, 120*b*, 118 from its natural quarter wavelength at 2.46 Ghz.

For highband lower (HB-L) RF such as 5.07 GHz, the physical dimensions of the conductors are selected to provide a radiating structure comprising, in sequence, sixth segment 118, fifth segment common radiator 120*b*, bridge 130, seventh segment HB-L radiator 128*a*, and eighth segment 132, and these elements together form a half wavelength radiator at the HB-L frequency.

FIG. 3 shows an example triband antenna, with 2.46 GHz LB structures 302, 5.07 GHz HB-L structures 304, and 5.57 GHz HB-U structures 306 shown. Each respective structure provides RF radiation for a respective band of frequencies, and provide minimum return loss at feedline 102 for the particular frequency in use.

Figure 4:
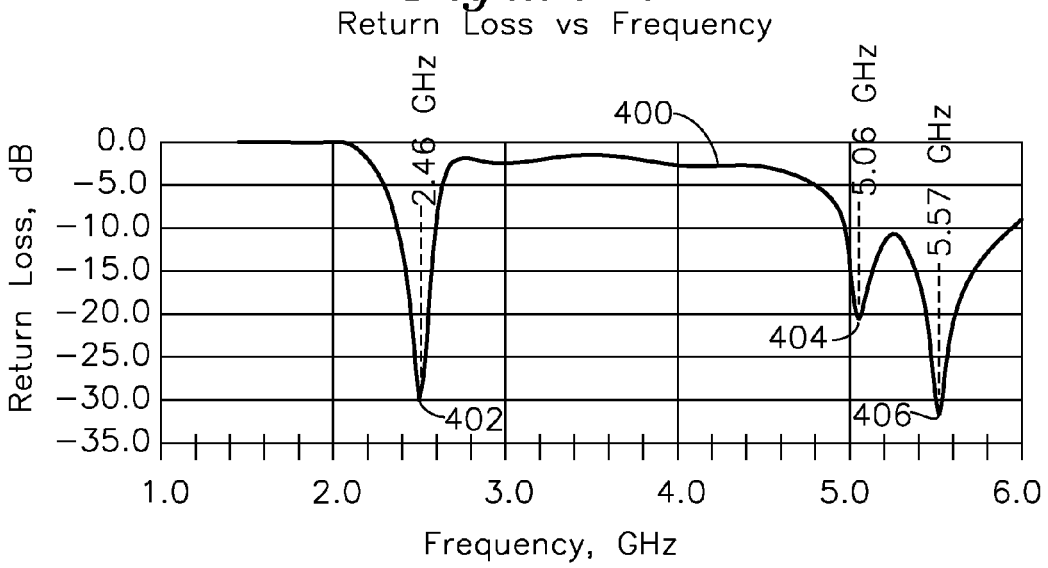
FIG. 4 is a plot of return loss versus frequency.

Without limitation of the scope of the invention, a series of dimensions is offered as an example, the design of which provides the return loss plot shown in FIG. 4. In this example, the various segments have the following lengths (segment long axis) and widths (segment short axis) with respect to the corresponding long and short axis shown in FIG. 1:

Left ground structure 104: 20 mm×5.62 mm;
Right ground structure 106: 20 mm×5.62 mm;
feedline 102: 20 mm×0.41 mm
gap between first (left) edge of feedline 102 and left ground structure 104: 0.17 mm;
gap between second (right) edge of feedline 102 and right ground structure 106: 0.17 mm
sixth segment 118: 5.35 mm×0.60 mm;
fifth segment 120 (120*a*+120*b*): 4.4 mm×0.65 mm;
fifth segment common radiator 120*b* 2.1 mm×0.65 mm;
bridge 130: 0.3 mm×0.3 mm;
fourth segment 122: 4.8 mm×0.6 mm;
seventh segment HB-L radiator 128*a:* 2.8 mm×0.5 mm;
seventh segment (128*a*+128*b*): 10.5 mm×0.5 mm;
eighth segment 132: 5.85 mm×0.35 mm;
ninth segment 126: 0.3 mm×0.5 mm;
tenth segment 124: 5.45 mm×0.5 mm;
first segment 108+first stub 110: 5 mm×0.41 mm;
second segment 112: 4.04 mm×0.7 mm;
first stub 110: 0.95 mm×0.41 mm;
third segment 114: 2.1 mm×0.5 mm;
ground reference structure 116: 2.5 mm×1.45 mm.

In the example embodiment of the invention shown in FIG. 1, the HB-U radiation structure includes first segment 108 which is substantially perpendicular to second segment 112, and second segment 112 which is substantially perpendicular to third segment 114, although other segment angles are possible, and feedline 102 may have any angular relationship to first segment 108, although it is shown as parallel as an example only. The LB radiation structure includes fourth segment 122, which is perpendicular to fifth segment LB radiator 120*a*, and sixth segment 118 is substantially perpendicular to fifth segment common radiator 120*b*. The HB-L radiation structure includes sixth segment 118 which is substantially perpendicular to fifth segment common radiator 120*b* and parallel to seventh segment HB-L radiator 128*a*, and seventh segment HB-L radiator 128*a* is substantially perpendicular to eighth segment 132 and also parallel to fifth segment common radiator 120*b*. The LF inductive structure includes segment 128*b*, which is parallel to seventh segment HB-L radiator 128*a* and also perpendicular to ninth segment 126, and ninth segment 126 is substantially perpendicular to tenth segment 124 which is parallel to the fifth segment LB radiator 120*a* or fifth segment common radiator 120*b*, as shown in FIG. 1.

FIG. 5 shows another embodiment of the invention having a tri-band antenna radiating region 140, fed by the same co-planar feedline 102 with edge-coupled left ground structures 104 and right ground structure 106 as was described for FIG. 1.

A HB-U radiating structure is formed by first segment 502 coupled to second segment 504. The other structures third segment 510, fourth segment 512, fifth segment 514, sixth segment 516, and seventh segment 518 have inductive coupling at HB-U radiating frequencies, and have minimal effect for HB-U frequencies.

A LB radiating structure is formed by third segment 510, fourth segment 512, and fifth segment 514, which is terminated in left ground structure 104. For LB radiation, first segment 502 acts primarily to couple RF energy across gap 508 to the LB RF radiating structure, and an inductive structure for LB RF is formed by sixth segment 516 and seventh segment 518.

The HB-L radiating structure is formed by fourth segment 512, sixth segment 516, and seventh segment 518. HB-L RF is coupled to the HB-L RF structure through first segment 502 and gap 508 to third segment 510, and also through second segment 504 to seventh segment 518 to the HB-L radiating structure 512, 516 and 518.

Figure 6:
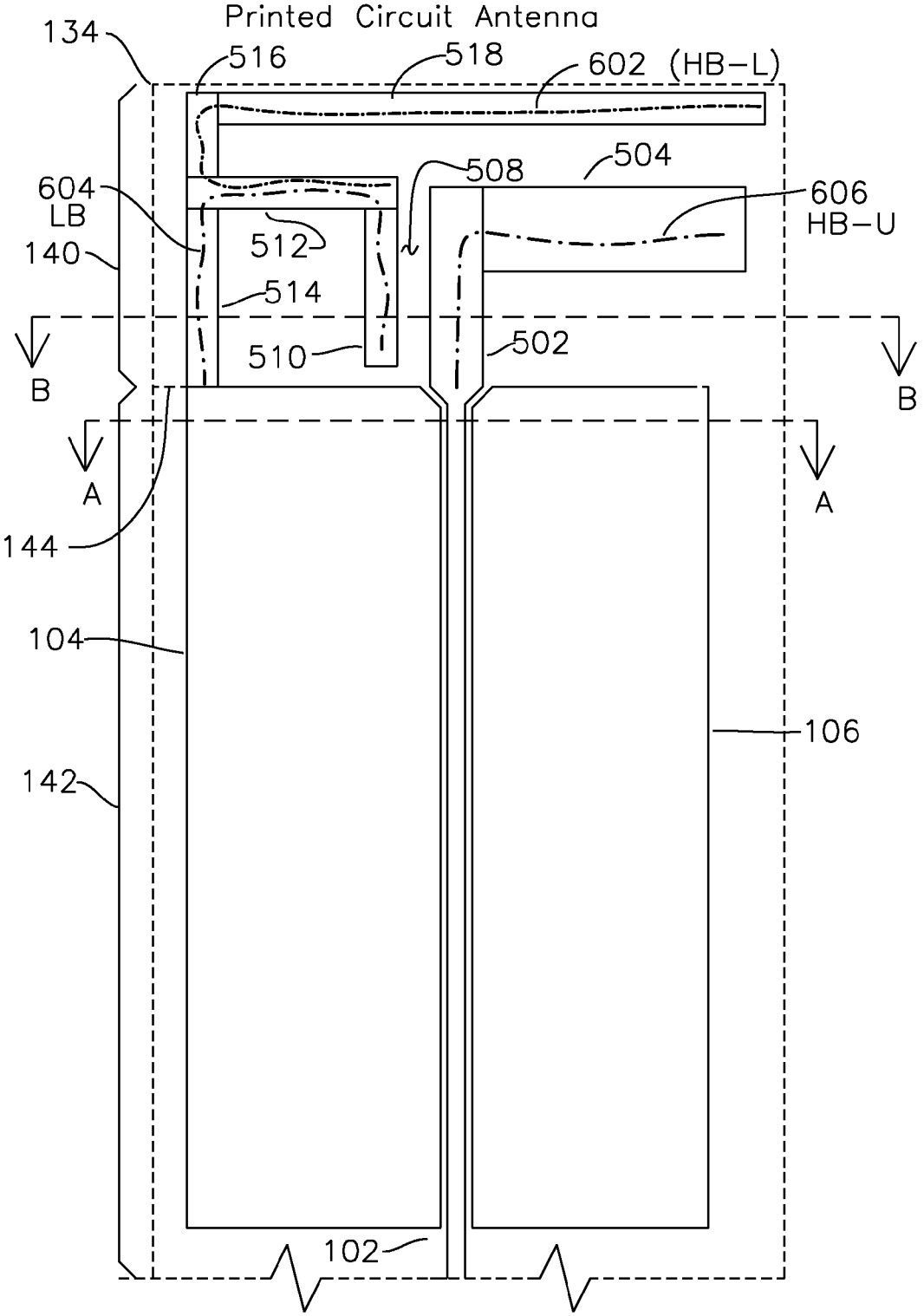
FIG. 6 is a plan view of the antenna of FIG. 5.

FIG. 6 shows the HB-U radiating structure path 606, with LB radiating structure path 604 and UB-L radiating structure path 602. In an example embodiment for use with WLAN frequencies, the segments of FIG. 5 have the following dimensions:

first segment 502: 4.75 mm×1.25 mm;
second segment 504: 6.25 mm×2 mm;
third segment 510: 3.75 mm×0.75 mm;
fourth segment 512: 5 mm×0.75 mm;
fifth segment 514: 4.25 mm×0.75 mm;
sixth segment 516: 2 mm×0.75 mm;
seventh segment 518: 13 mm×0.75 mm
gap 508: 0.8 mm.

Other arrangements of the HB-U, LB, and HB-L radiators are possible, but the example embodiment of FIGS. 6 and 7 shows HB-U radiator first segment 502 substantially parallel to feedline 102 and perpendicular to second segment 504. The LB radiator structure shown has third segment 510 substantially parallel to fifth segment 514, both of which are and substantially perpendicular to fourth segment 512. The HB-L radiator structure has the fourth segment 512 substantially parallel to seventh segment 518, both of which are substantially perpendicular to sixth segment 516.

The proceeding has been a description of the preferred embodiments of the invention. It will be appreciated that deviations and modifications can be made without departing from the scope of the invention. In particular, the following modifications may be made individually, or in combination:

a) placement of any of the radiating structures or individual segments of the radiating structures on layers other than the top layer;

b) removal of bridge 130 of FIG. 1;

c) removal of reference ground segment 116 of FIG. 1;

d) reduction of the length of eighth segment 132 of FIG. 1;

e) reduction or removal of third segment 114 of FIG. 1;

f) mirroring of one or more segments of FIG. 1 or 5 about an axis;

g) rotation of any one or more segments of a radiating structure.

Any of the above modifications may be made through compensation of the lengths or dimensions of other structures to maintain the frequency characteristics desired. Dimensions which are provided for each of the segments of the corresponding embodiments are for exemplar use with the particular frequency given, and it is understood that any dimensioned segment of the previously described radiation structures may be modified +/−20 percent and still be usable for the specified WLAN frequencies. The term "substantially" with regard to dimensions is understood to mean+/−20 percent variation, and the term "substantially" with regard to parallel or perpendicular is understood to mean within 10 degrees of true parallel or perpendicular, respectively. the term "substantially" with respect to a particular frequency is understood to mean within +/−20 percent of the particular frequency. The scope of the invention is defined by the claims which follow.

We claim:

1. A multi-band printed circuit antenna for radio frequency (RF) and having:

a feedline region and a radiation region, the feedline region having an upper trace plane and a ground plane separated by a dielectric;

said feedline region having a feedline conductor carrying RF in at least one of a lowband (LB) frequency which is lower than a highband-low (HB-L) frequency, and an highband-upper (HB-U) frequency which is higher than said HB-L frequency;

said feedline region having a first feedline conductor coupled to a HB-U radiating structure formed by the sequence of a first segment, a second segment perpendicular to said first segment, and a third segment parallel to said first segment, said HB-U radiating structure also having a stub extending from said first segment for coupling RF at other frequencies;

said first segment and said stub coupling said HB-L RF and said LB RF across a gap to a fourth segment parallel to said first segment, said fourth segment coupled, in sequence, to a fifth segment LB radiator perpendicular to said first segment, a fifth segment common radiator formed by extension of said fifth segment LB radiator, and a sixth segment terminating into a grounded reference, said sixth segment parallel to said first segment, said fourth segment, said fifth segment LB radiator, said fifth segment common radiator and said sixth segment forming a LB radiating structure for LB RF;

the intersection of said fifth segment common radiator and said fifth segment LB radiator coupled to a bridge, said bridge coupled to a seventh segment HB-L radiator perpendicular to said first segment and an eighth segment HB-L radiator parallel to said first segment;

an HB-L RF radiation structure formed by said sixth segment, said fifth segment common radiator, said bridge, said seventh segment HB-L radiator, and said eighth segment HB-L radiator;

an LF inductive structure formed by the sequence of a seventh segment inductive extending from said seventh segment HB-L radiator and from said bridge, said seventh segment inductive having an opposite end coupled to a ninth segment, and a tenth segment terminating in the intersection of said fourth segment and said fifth segment LB radiator, said ninth segment and said tenth segments perpendicular to said first segment;

where said first segment, said second segment, said third segment, said fourth segment, said fifth segment common radiator, said fifth segment LB radiator, said sixth segment, said seventh segment inductive, said seventh segment HB-L radiator, said eighth segment, said ninth segment, and said tenth segment are rectangular in shape.

2. The printed circuit antenna of claim 1 where said first segment and said second segment have one edge coupled to a ground reference segment connected to ground.

3. The printed circuit antenna of claim 1 where said LB frequency is in the range from 2.38 to 2.52 GHz.

4. The printed circuit antenna of claim 1 where said HB-L frequency range and HB-U frequency range extend from 4.89 GHz to 5.91 GHz, over which frequency range said printed circuit antenna has a VSWR of less than 2:1.

5. The printed circuit antenna of claim 1 where said feedline return loss is less than −10 db over a first frequency range of 2.38 Ghz to 2.52 Ghz and also over a second frequency range of 4.89 GHz to 5.91 GHz.

6. The printed circuit antenna of claim 1 where said LB frequency is substantially 2.46 Ghz.

7. The printed circuit antenna of claim 1 where said HB-L frequency is substantially 5.07 GHz.

8. The printed circuit board antenna of claim 1 where said HB-U frequency is substantially 5.57 GHz.

9. The printed circuit board antenna of claim 1 where said feedline is edge coupled to at least one of a co-planar left ground structure or a co-planar right ground structure without a ground plane reference on a different plane.

10. The printed circuit board antenna of claim 1 where said feedline includes a co-planar left ground structure, co-planar right ground structure, and a ground plane that is not co-planar to said feedline.

11. The printed circuit board antenna of claim 1 where said sixth segment has dimensions of substantially 5.35 mm×0.6 mm, said fifth segment common radiator has dimensions of substantially 2.1 mm×0.65 mm, said bridge has dimensions of substantially 0.3 mm×0.3 mm, said seventh segment HB-L radiator has dimensions of substantially 2.8 mm by 0.5 mm, and said eighth segment has dimensions of substantially 5.85 mm by 0.35 mm.

12. The printed circuit board antenna of claim 1 where fourth segment has dimensions of substantially 4.8 mm by 0.6 mm, said fifth segment LB radiator combined with said fifth segment common radiator has dimensions of substantially 4.4 mm by 0.65 mm, and said sixth segment has dimensions of substantially 5.35 mm by 0.6 mm.

13. The printed circuit board antenna of claim 1 where said first segment with said stub has dimensions of substantially 5.0 mm by 0.41 mm, said second segment has dimensions of substantially 4.04 mm by 0.70 mm, and said third segment has dimensions of substantially 2.1 mm×0.5 mm.

14. The printed circuit antenna of claim 1 where said feedline conductor and said first segment are either co-linear or substantially parallel to each other.

15. The printed circuit antenna of claim 14 where said second segment is substantially perpendicular to said feedline.

16. The printed circuit antenna of claim 1 where said first segment and said stub have a common width.

17. The printed circuit antenna of claim 1 where said seventh segment HB-L radiator and said seventh segment inductive are co-linear.

18. The printed circuit antenna of claim 1 where said eighth segment is substantially parallel to said feedline.

* * * * *